United States Patent [19]

Sochard et al.

[11] 4,010,689

[45] Mar. 8, 1977

[54] APPARATUS FOR SENSING TARGET DISTANCE

[75] Inventors: Irving I. Sochard, Chevy Chase; Marcella C. Petree, Silver Spring; Wallace N. Knutsen, Silver Spring; Frederick E. Warnock, Silver Spring; Edward A. White, Jr., Beltsville, all of Md.

[73] Assignee: The United States of America as represented by the Secretary of the Navy, Washington, D.C.

[22] Filed: Dec. 23, 1970

[21] Appl. No.: 97,477

[52] U.S. Cl. ..... 102/70.2 P

[51] Int. Cl.[2] ..... F42C 13/02; F42C 13/04; F42C 13/00

[58] Field of Search ..... 102/70.2 P, 70.2 R; 250/435 D; 343/5; 244/3.16

[56] References Cited

UNITED STATES PATENTS

| | | | |
|---|---|---|---|
| 2,457,393 | 12/1948 | Muffly | 294/3.16 X |
| 3,129,424 | 4/1964 | Rabinow | 102/70.2 P |
| 3,332,077 | 7/1967 | Nard et al. | 102/70.2 P |
| 3,508,046 | 4/1970 | Anton et al. | 250/43.5 D |
| 3,527,167 | 9/1970 | Morse | 102/70.2 R |

*Primary Examiner*—Stephen C. Bentley
*Assistant Examiner*—Thomas H. Webb

[57] ABSTRACT

A fuze for accurately sensing the distance to a target irrespective of the presence of a medium intermediate of the fuze and the target. The fuze includes a source of radiation which is transmitted to the target and a detector which detects the backscatter from the target and intervening media. The detector output is amplified in an amplifier connected thereto and filtered in a filter connected to the amplifier to provide an output signal which is threshold detected in a threshold device connected to the amplifier. The threshold detected signal is applied to a firing circuit to provide a signal responsive to a predetermined distance above the target.

2 Claims, 4 Drawing Figures

Irving I. Sochard
Marcella C. Petree
Wallace N. Knutsen
Frederick E. Warnock
Edward A. White, Jr.
INVENTORS Barry A. Cooper
AGENT BY J. A. Cooke
ATTORNEY

APPARATUS FOR SENSING TARGET DISTANCE

BACKGROUND OF THE INVENTION

This invention relates generally to distance sensing devices and, more particularly, to a proximity ordnance fuze.

Prior art ordnance proximity fuzes have been devised which transmit a signal to a reflecting target surface and analyze the time difference between the transmitted and received echo signals to provide an indication of the distance between the ordnance vehicle in which the fuze is located and the target. These prior art ordnance fuzes have worked relatively satisfactorily where the reflecting target surface is a rigid, hard surface, such as ground level or the like, but have been somewhat unsatisfactory where the reflecting surface is not the actual target. Thus, for example, where the ordance fuze is located in any aerial ordnance vehicle, such as, for example, a bomb or a projectile, and where ground level is the target against which it is desired to detonate the vehicle a predetermined burst height distance above, but the target is covered by an intervening media, such as a foliage canopy or the like, the transmitted signal will be reflected by the foliage canopy rather than by the ground target thereby yielding a burst height which is referenced to the foliage canopy rather than the level of the ground target. Such action considerably reduces the lethality of the ordnance vehicle.

Systems have been devised which attempt to accurately obtain the desired burst height distance with reference to the target rather than with reference to intervening media, such as foliage or the like. One such system utilized in aerial ordnance devices, such as bombs or projectiles, senses the foliage canopy and, rather than immediately detonating the bomb which would provide a burst height with reference to the foliage canopy, delays detonation a predetermined time to allow the ordnance device to more closely approach the intended target to obtain an approximate burst height with reference to the target. This system, however, has proven less than satisfactory since the foliage canopies are not always of uniform height which results in improperly chosen time delays and, consequently, inaccurate and ineffective burst heights. Similarly, this system is unsatisfactory where the ordnance fuze senses the desired target, for example, through a clearing to the foliage or the like, but is preset with a predetermined time delay resulting, therefore, in an unwarranted detonation delay and consequent less lethal or ineffective detonation.

Furthermore, prior art ordnance fuzes are prone to premature detonation or the like by RF fields. These RF fields may result from stray RF signals or may be part of a complex countermeasure technique directed at the fuze. Conventional ordnance fuzes are not able to be adequately shielded from RF fields since these fuzes require at least some opening in the ordnance device in which they are located for transmitting a signal to a target and for receiving the echo signal therefrom.

SUMMARY OF THE INVENTION

Accordingly, one object of the present invention is to provide an accurate distance measuring device for use in aerial vehicles.

Another object of the present invention is to provide an ordnance fuze insensitive to the presence of an intervening medium, such as, for example, a foliage canopy or the like.

A still further object of the instant invention is to provide an ordnance fuze capable of accurately sensing a desired burst height.

Another object of the invention is to provide an active proximity ordnance fuze which is completely shielded from RF signals or the like.

A further object of the present invention is to provide a device for accurately sensing the distance to a target despite the presence of intervening media.

Briefly, these and other objects of the invention are attained by providing a device utilizing a radiation source, such as X-rays or gamma-rays, which is transmitted to a target and a detector which detects the backscatter of the transmitted signal as the device approaches the target. The radiation source and the detector are RF shielded and geometrically arranged so that the detection of backscatter is weighted as a function of the distance between the device and the backscatter.

BRIEF DESCRIPTION OF THE DRAWINGS

A more complete understanding of the invention and many of the attendant advantages thereof will be readily appreciated as the same becomes better understood by reference to the following detailed description when considered in connection with the accompanying drawings wherein.

DESCRIPTION OF THE PREFERRED EMBODIMENT

Figure 1:
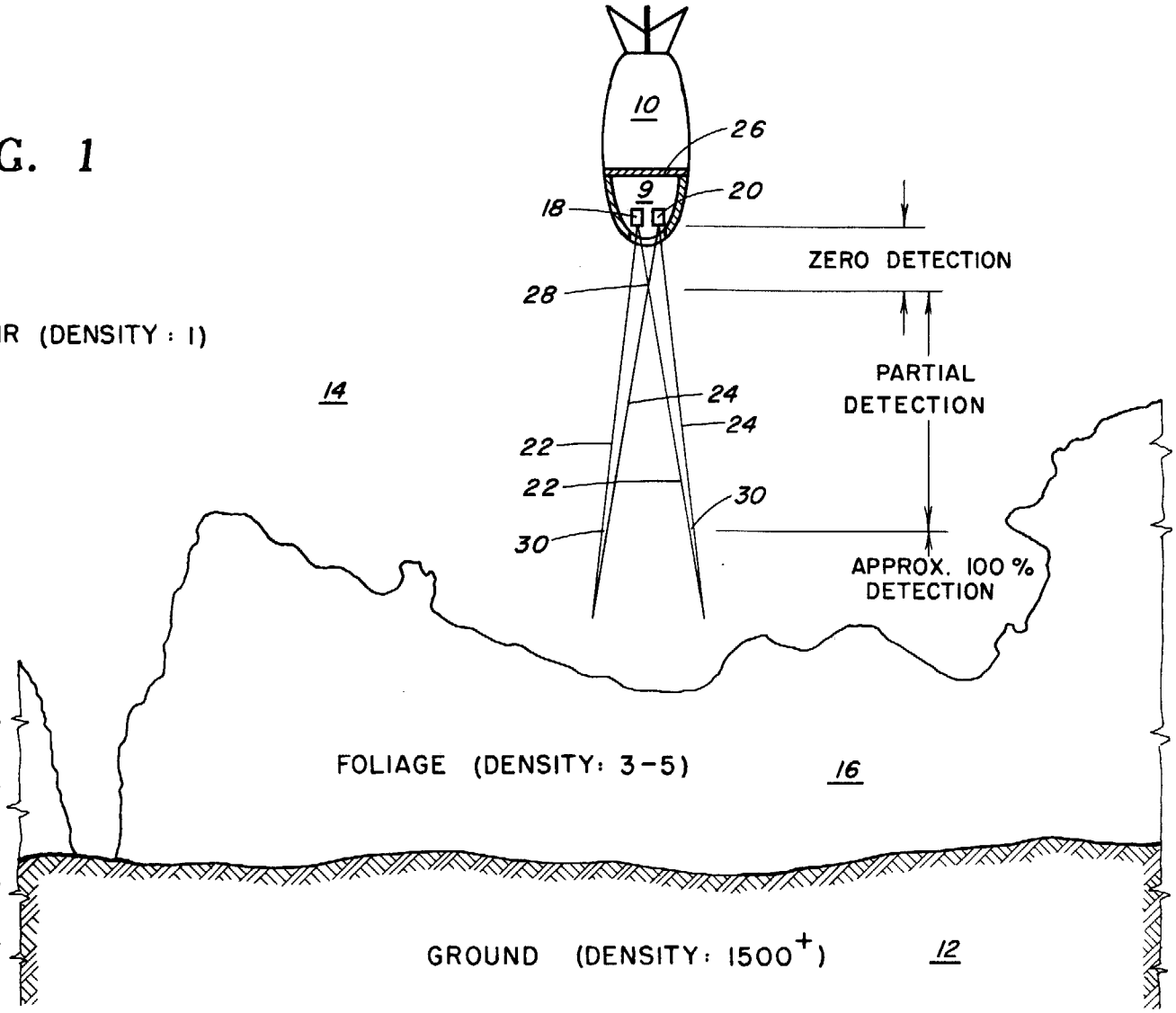
FIG. 1 is a schematic view of the fuze according to the present invention located in an ordnance vehicle approaching a target in the presence of an intervening medium.

Referring now to the drawing and more particularly to FIG. 1 thereof, the fuze 9 according to the present invention is shown as located within an ordnance vehicle 10, such as an aerial bomb or a projectile, substantially vertically approaching a target, which may be, for example, ground 12, through an air space 14. An intervening medium, such as a foliage canopy 16, is intermediate of bomb 10 and the ground target 12.

A conventional radiation source, such as a X-ray or gamma-ray source 18, and a conventional radiation detector 20 are disposed within fuze 9 at the nose or forward position of bomb 10. Radiation source 18 is adapted to provide X-rays or gamma-rays of a predetermined energy sufficient to be transmitted from the source via an appropriate aperture (not shown) in the source. A radiation shield 19 (FIG. 2) is connected to source 18 to direct the transmitted radiation from the fuze toward target 12 in a diverging path 22. Similarly, detector 20 is adapted to detect the backscatter of the transmitted radiation signal provided by source 18. More particularly, detector 20 includes a radiation shield 21 (FIG. 2) which limits detection of backscatter to that occurring within a diverging path 24. It is to be noted that the utilization of a radiation source and a detector therefor allows the fuze to be completely RF shielded from stray RF signals or RF counter measures or the like by a conventional RF shield 26 which totally surrounds the fuze since the transmitted and detected radiation signals do not require an opening in sheild 26 for transmission and reception, respectively, from target 12. The fuze of the present invention provides an accurate indication of distance or burst height with reference to a desired target, such as ground 12, by detecting the backscatter of the transmitted radiation as the fuze approaches the target.

The ability of media to backscatter a signal is related to the density of the media. Taking, for purposes of backscatter ability, the density of air, foliage, and ground to be 1 unit, 3–5 units, and 1500+ units, respectively, the backscatter ability will be 1500+ times greater when the medium is ground and 3–5 times greater when the medium is foliage than when the medium is air. The detected backscatter is a function of the backscatter ability of the various media involved and is also related to the distance between the various media and the detector. More particularly, the detected backscatter is inversely proportional to the square of the distance between the backscattering medium and the detector and is directly proportional to the backscatter ability of the backscattering medium. Furthermore, over the range of operation of the fuze, absorption of the transmitted radiation signal will not significantly affect operation. Thus, for example, assuming the backscatter medium is air and assuming there is only negligible absorption as the radiation signal is transmitted through the air, the absolute backscatter, that is, the backscatter occurring within a specified volume of air, is approximately equal to the absolute backscatter occurring within another equal volume of air. However, if the volumes are at different distances from a detector, the detected backscatter will be greater from the closer volume than from the farther volume and the backscatter detected will vary as the inverse square of the distance between the particular volume and detector. Thus, while the absolute backscatter are equal, the detected backscatter from the air immediate the detector will be greater than the detected backscatter from air more distant from the detector. Similarly, if the radiation signal is backscattered by plural media each exhibiting different backscatter abilities, such as air and ground, while the absolute backscatter is signicantly greater from ground than from air, the detected backscatter will be disproportionately greater from the air (especially from the air immediate the detector) than from the ground level as a result of the inverse square distances between the media, the air medium being closer to the detector than the ground. It is readily apparent, therefore, that media in close proximity to the detector will have a disproportionate effect on the detected backscatter despite the fact that the absolute backscatter from the nearly medium is relatively small and the detector may be "blinded" by the medium in close proximity thereto. Likewise, since media in close proximity to the detector provides a disproportionately large detected backscatter, it may appear to the ordnance fuze that the desired target is nearer resulting, therefore, in a premature detonation.

The radiation source 18 and the radiation detector 20 are geometrically or physically arranged so that the backscatter detected in the fuze is weighted to provide an accurate indication of the absolute backscatter despite the disproportionate back-scatter which would otherwise be detected due to a medium in close proximity to the detector. More particularly, FIG. 1 shows radiation transmission path 22 and radiation detection path 24 intersecting at a cross-over point 28 forwardly of fuze 9. As indicated therein, the geometrical or physical relationship between source 18 and detector 20 which enables diverging paths 22 and 24 to intersect, divides the space about the fuze into zones of varying detection. Thus, between cross-over point 28 and fuze 9, detector 20 will detect no backscatter due to any media located therebetween since path 22 does not overlap path 24 in this zone. Similarly, between cross-over point 28 and point 30 backscatter detection will only be partial due to partial overlap of paths 22 and 24. It is to be noted that within this partial detection zone, the detection will increase from point 28 to point 30 as the overlap of paths 22 and 24 increases. Similarly, from point 30 onward, approximately 100% of the backscatter occurring therein will be detected. It is readily apparent, therefore, that by arranging the overlap of paths 22 and 24, a weighted detection is provided and allowance is made for the inverse square law effect which would provide a disproportionately greater detected backscatter due to media in close proximity to the fuze. Thus, the detected backscatter is more closely related to the absolute backscatter occurring in media near the ordnance fuze. As hereinbefore mentioned, if the fuze did not exhibit these weighted zones of detection, the detected backscatter from air in close proximity to bomb 10 would appear much greater than the absolute backscatter actually due to this air and, therefore, it is possible that the fuze would appear to be closer to a more dense target, such as ground 12, resulting in premature detonation of bomb 10. It is also to be noted that less divergent transmission and detection paths intersecting at a greater distance from fuze 9 may provide a more accurate indication of burst height.

Figure 2:
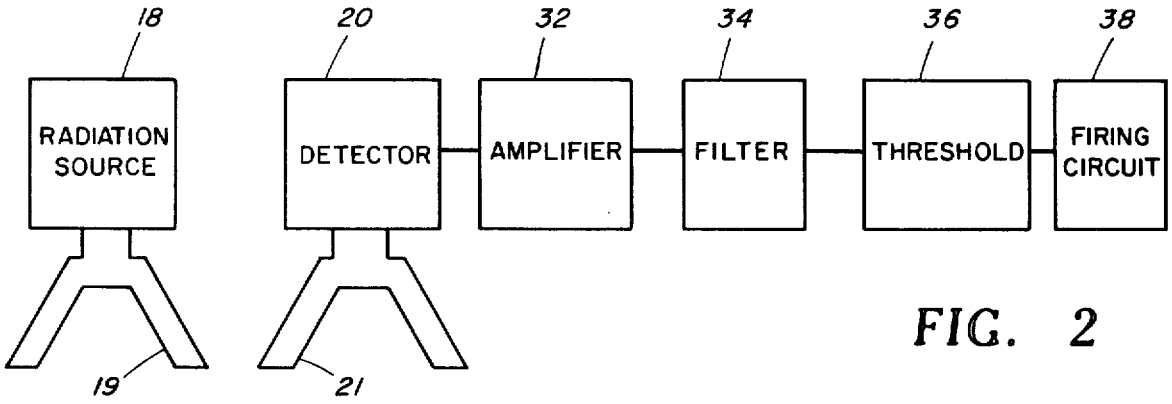
FIG. 2 is a block diagrammatic view of the fuze according to the present invention.

FIG. 2 is a block diagrammatic view of fuze 9 according to the present invention. Radiation source 18 may be any desired source of X-ray or gamma-ray radiation, or the like, of sufficient energy to be transmitted towards a target. A radiation shield 19 is connected to source 18 and is adapted to project the radiation towards a target in a diverging path as thereinbefore explained. Similarly, detector 20 may be of any conventional type, for example, as halogen quenched geiger counter, a proportional counter, a solid state gamma-ray detector counter, an ionization chamber, a scintillation counter, or the like, and may include a radiation shield 21 connected thereto to restrict detection to a predetermined diverging path. The backscatter from radiation source 18 is detected by detector 20 and may be amplified in a conventional amplifier 32 coupled to the detector. A filter 34 may be connected to the amplifier output to remove sharp backscatter spikes from the amplified output which might otherwise prematurely trigger the fuze. A threshold detector 36 is connected between filter 34 and a utilization circuit, such as, for example, a conventional firing circuit 38 to provide an output or actuation signal when the detected backscatter is of a predetermined value corresponding to the desired burst height.

Figure 3:
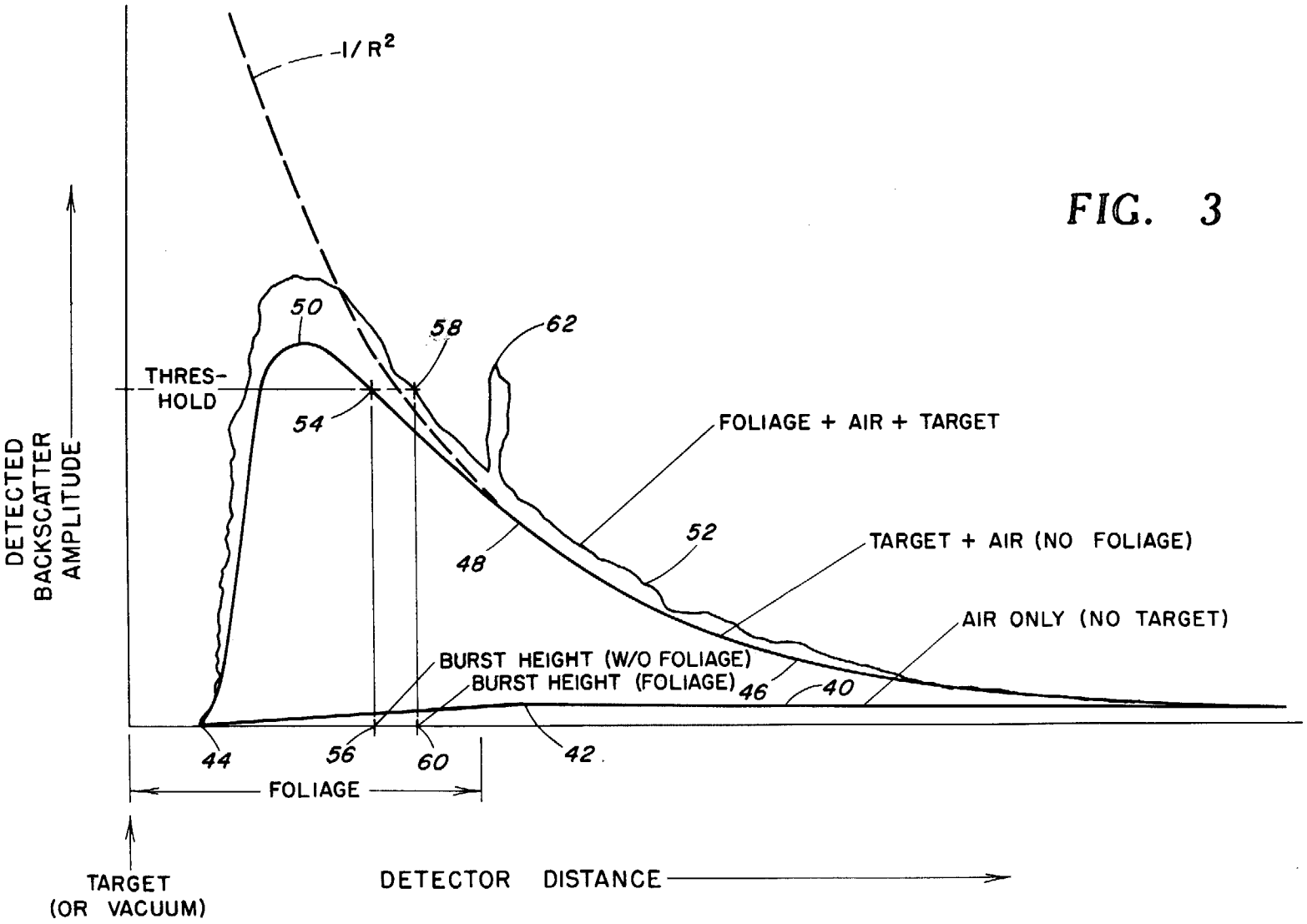
FIG. 3 is a graphical view of various backscatter signals associated with the fuze of FIG. 1; and, FIG. 4 is a graphical view of maximum burst height distance obtainable with various energy sources utilized in the fuze of FIG. 2.

The operation of the fuze may be better understood by reference to FIG. 3 wherein various detected backscatter signals are shown. Waveform 40 shows the variation of the output of detector 20 as the fuze 9 carried by bomb 10, approaches a vacuum medium (which does not backscatter) through an air medium. In such cases, the output of detector 20 is relatively constant at distances away from the air-vacuum boundary. As the bomb approaches the boundary, the effect of the partial detection zone, that is, detection between cross-over point 28 and total detection point 30 (FIG. 1), will become more pronounced and the detector output gradually decreases. At 44, the detected output reaches zero indicating that the zero detection region, that is, the zone between detector 20 and cross-over point 28, has been reached. It is to be noted that the air-vacuum boundary is not at 44 but rather at the origin of FIG. 3, however, the detector is insensitive to backscatter within the zero detection zone and, therefore, detection will cease and the detected output will fall to zero once the boundary enters the zero detection zone.

Waveform 46 shows the variation in detector output as the fuze approaches a target through an air medium absent any foliage intermediate the bomb and the target. At relatively large distances from the target, the fuze detects only the air backscatter since the absolute backscatter from ground is farther from the target and substantially affected by the inverse square law effect so that the detected backscatter resulting therefrom is greatly reduced. Furthermore, absorption losses and the like become more pronounced at greater distances from the radiation source. As the fuze more closely approaches the target, detector 20 will detect the ground backscatter and the detector output will initially follow the $1/R^2$ curve shown in dashed line. The detector output follows the $1/R^2$ curve until 48 and thereafter increases at a slower rate since the ground backscatter will start to come from the partial detection zone and, therefore, proportionally less absolute backscatter will be detected as the fuze approaches ground level. The detector output will peak at 50 and rapidly fall to zero at 44 since the detection in the partial detection zone decreases in the vicinity of cross-over point 28 and is zero in the zero detection zone between point 28 and detector 20.

Waveform 52 shows the effect of foliage media intermediate target 12 and bomb 10. In contradistinction to previously employed fuzes, the fuze of the present invention is not adversely effected by intervening media, such as foliage or the like, and the burst height in foliage is relatively close to the burst height absent foliage as is apparent from FIG. 3. More particularly, waveform 52 generally follows the shape of waveform 46 indicating that the backscatter detected by the fuze in the presence of a foliage medium closely approximates the backscatter detected in a foliagefree environment. If, therefore, threshold detector 36 is adjusted to threshold detect backscatter at a level 54 corresponding to a burst height 56 absent foliage, backscatter level at 58 corresponding to detected backscatter in the presence of a foliage medium will provide a burst height 60 in close relation to burst height 56. To prevent the threshold detector from detecting spurious backscatter signals, such as indicated at 62, filter 34 smooths the detected waveform to eliminate sharp backscatter spikes corresponding to a spurious detected signal. It is readily apparent that other methods for eliminating spurious backscatter signals may be utilized if desired. Thus, an integrator may be included within threshold detector 36 to require the threshold signal to be reached for a minimum predetermined time before the firing circuit is initiated.

Figure 4:
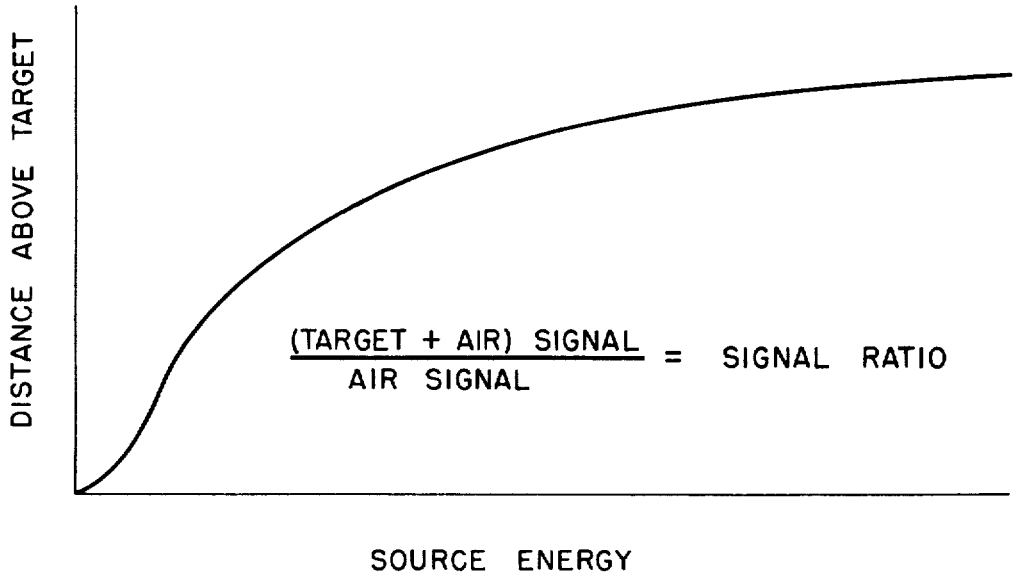

The variation in the radiation energy from source 18 as a function of the ability of fuze 9 to discern between a target and foliage is shown in FIG. 4. Defining a figure of merit representative of the ability to distinguish a target to be the ratio of detected backscatter due to a target and air to the detected signal in air alone and setting this figure of merit to a predetermined value, the graph indicates that an increasing energy source is capable of discerning between a desired target and foliage at greater distances above the target.

It is readily apparent, therefore, that the present invention provides an ordnance fuze for obtaining burst height information referenced to a desired target despite the presence of intervening media.

Obviously, numerous modifications and variations of the present invention are possible in the light of the above teachings. Thus, the detection system of the present invention may be utilized elsewhere than in an ordnance fuze vertically approaching a target. For example, the detection system of the present invention may be utilized as a low level altimeter, or a parachute ejection actuator, or other distance measuring or responsive device for an airborne device. It is therefore to be understood that within the scope of the appended claims, the invention may be practiced otherwise than as specifically described herein.

What is claimed as new and desired to be secured by Letters Patent of the United States is:

1. A distance sensing device comprising a radiation source for producing a radiation signal;

a first radiation shield for transmitting said radiation signal to a target in a first predetermined path;

a radiation detector having a second radiation shield for restricting detection of backscatter within a second predetermined path, said first and second predetermined paths intersecting to define zones of detection;

means for detecting a weighted portion of the backscatter of said transmitted radiation signal within each zone of detection, said weighted detected backscatter corresponding to the absolute backscatter of said transmitted signal, and means for providing an actuation signal when said detected backscatter exceeds a predetermined value corresponding to a predetermined distance to said target.

2. A distance measuring device according to claim 1 further comprising means for amplifying said detected backscatter signal, means for filtering said amplified detected signal to remove spurious signals therefrom; and means for shielding said distance sensing device from RF signals.

* * * * *